United States Patent [19]

Scheinecker

[11] Patent Number: 4,489,495

[45] Date of Patent: Dec. 25, 1984

[54] ARRANGEMENT FOR MEASURING TWO OPPOSITELY ARRANGED ROLLERWAYS OF A CONTINUOUS CASTING PLANT

[75] Inventor: Alois Scheinecker, Linz, Austria

[73] Assignee: Voest-Alpine Aktiengesellschaft, Linz, Austria

[21] Appl. No.: 422,877

[22] Filed: Sep. 24, 1982

[30] Foreign Application Priority Data

Oct. 9, 1981 [AT] Austria ..... 4345/81

[51] Int. Cl.[3] ..... G01B 7/04; G01B 7/14

[52] U.S. Cl. ..... 33/143 L; 33/147 K; 33/147 L; 33/182

[58] Field of Search ..... 33/143 L, 147 K, 147 L, 33/147 N, 174 L, 182, DIG. 13

[56] References Cited

U.S. PATENT DOCUMENTS

| | | | |
|---|---|---|---|
| 3,983,631 | 10/1976 | Dutzler | 33/143 L |
| 4,178,692 | 12/1979 | Schultz | 33/143 L |
| 4,344,232 | 8/1982 | Kihlstrom | 33/143 L |
| 4,354,315 | 10/1982 | Hecht | 33/182 |
| 4,361,962 | 12/1982 | Scheurecker et al. | 33/143 L |

FOREIGN PATENT DOCUMENTS 0028215 9/1980 European Pat. Off. .

*Primary Examiner*—Richard R. Stearns

*Attorney, Agent, or Firm*—Brumbaugh, Graves, Donohue & Raymond

[57] ABSTRACT

An arrangement for measuring two oppositely arranged rollerways of a continuous casting plant comprises a measuring body movable through the section between the rollerways. The measuring body has opposite contact surfaces contacting the surface areas of the rollers and formed by elastically deformable spring strips. They are pressable to the surface areas of the rollers by pressure means arranged between them. In order to be able to measure rollerways with which the roller distance of the oppositely located rollers is exactly accurate, yet individual or several roller pairs are arranged offset relative to other roller pairs, at least on one of the spring strips a distance-alteration measuring means is provided, substantially extending in the moving direction of the arrangement.

5 Claims, 6 Drawing Figures

ARRANGEMENT FOR MEASURING TWO OPPOSITELY ARRANGED ROLLERWAYS OF A CONTINUOUS CASTING PLANT

BACKGROUND OF THE INVENTION

The invention relates to an arrangement for measuring two oppositely arranged rollerways of a continuous casting plant, comprising a measuring body movable through the section between the rollerways and having opposite contact surfaces contacting the surface areas of the rollers, which contact surfaces are formed by elastically deformable spring strips, in particular spring steel strips, the contact surfaces being pressable to the surface areas of the rollers by pressure means arranged between them.

An arrangement of this kind is known from U.S. Pat. No. 4,361,962. By this arrangement, the distance of two oppositely arranged rollerways can be exactly determined, wherein it is also possible to measure with precision the distance of the rollerways with rollers that are not exactly opposite each other and with rollerways having different roller divisions over their longitudinal extensions and changing conditions of curvature.

The invention has as its object to provide an arrangement of this kind in a manner that it can be used for measuring rollerways with which the roller distance of the oppositely located rollers is exactly accurate, yet individual or several roller pairs are arranged offset relative to other roller pairs.

SUMMARY OF THE INVENTION

This object is achieved according to the invention in that at least on one of the spring strips a distance-alteration measuring means is provided, substantially extending in the moving direction of the arrangement. Thereby, it is possible to ascertain a change in length of one of the spring strips, as occurs with the measuring means passing through offset roller pairs, and to detect rollerway offsets, as they might occur in particular with rollerways assembled of individual segments.

According to a preferred embodiment, at least one distance-alteration measuring means each is provided on the two spring strips, arranged opposite each other perpendicular to the moving direction of the arrangement. Thereby it is possible to differentiate a roller pair shift clearly from a distance fault of only one roller of the rollerways by a single passage of the arrangement through the rollerways.

Advantageously, each distance-alteration measuring means is inserted between two holding means mounted on the inner side of the spring strip, at least one of the holding means suitably being designed as a console directed approximately perpendicular to the contact surfaces of the spring strips and designed to be elongated to the vicinity of the oppositely arranged spring strip, and wherein, furthermore, the distance-alteration measuring means is inserted between the end of the console and a further holding means.

Inductive distance transducers have proved particularly suited for the rough steel works operation for the arrangement according to the invention.

For particularly accurate measurements, strain gauges applied onto the spring strip are suitably used.

BRIEF DESCRIPTION OF THE DRAWINGS

The invention will now be explained in more detail by way of two embodiments and with reference to the accompanying drawings, wherein.

DESCRIPTION OF EXEMPLARY EMBODIMENTS

Figure 1:
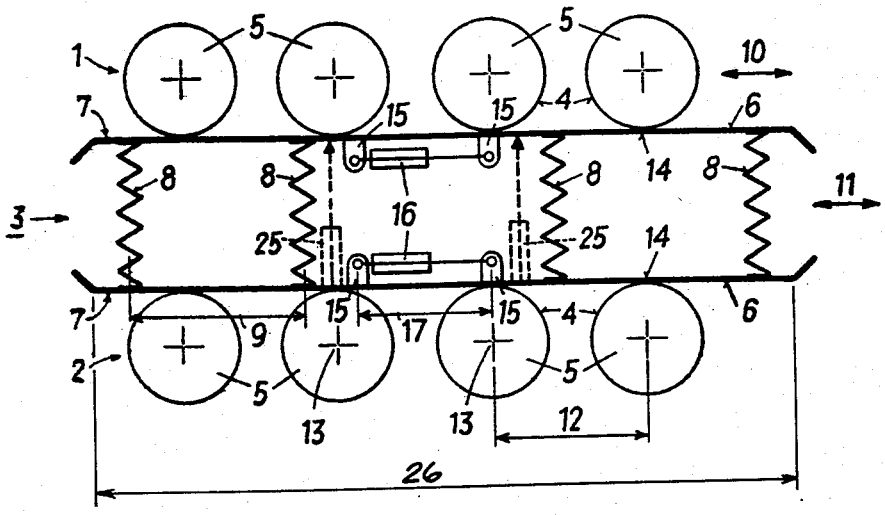
FIGS. 1 to 4 are schematic illustrations of the arrangement according to the invention in side view between two rollerways.

Between the rollerways 1 and 2 of a strand guide of a continous casting plant, an arrangement 3 for measuring the rollerways is inserted. Suitably, the arrangement comprises a coupling piece (not illustrated) by which it is fastenable by means of a coupling to a starter bar head of a starter bar for the purpose of passing it between the rollerways 1 and 2.

The arrangement includes two contact surfaces 6 that contact the surface areas 4 of the rollers 5, and are located on the outer side of elastically deformable spring strips 7, such as spring steel strips. The spring steel strips are pressed to the surface areas 4 of the rollers 5 by pressure means 8 arranged between them, for instance by spring cups or hydraulically or pneumatically actuated pressure means. The distance 9 of the pressure means 8 in the longitudinal direction 10 of the rollerways, and in the moving direction 11 of the arrangement, approximately corresponds to the distance 12 of the axes 13 of the rollers 5. Since, with continuous casting plants, the axes 13 of the rollers 5 are closely adjacent immediately below the mould, while being located at larger distances at the run-out side end of the plant, a mean value is suitably chosen in this case.

On the inner side 14 of each spring steel strip 7, holding means 15 rigidly connected with the spring steel strip are provided, between which a distance-alteration measuring means 16 substantially extending in the moving direction 11 of the arrangement 3 is inserted. The distance-alteration measuring means illustrated in the Figures is designed as an inductive distance transducer. The holding means 15 are designed as consoles directed approximately perpendicular to the contact surfaces of the spring strips, to which consoles the distance-alteration measuring means 16 are hinged without play. The distance 17 of the holding means 15 approximately corresponds to the distance 12 of the axes 13 of the rollers 5 of one of the rollerways 1,2, wherein also in this case a mean value of all the distances of the roller axes of a strand guideway suitably is chosen as the holding means distance 17.

Figure 2:
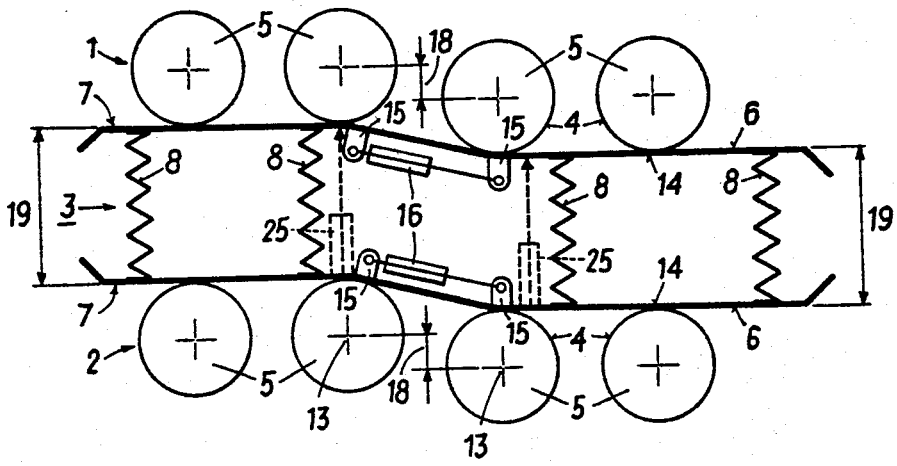

As can be seen from FIG. 2, the arrangement according to the invention, which may, for instance, be coupled to an arrangement according to U.S. Pat. No. 4,361,962, can also be used to find a roller offset 18, although the distance 19 of the oppositely arranged rollers of all the rollers 5 exactly corresponds to the ideal measure.

Figure 3:
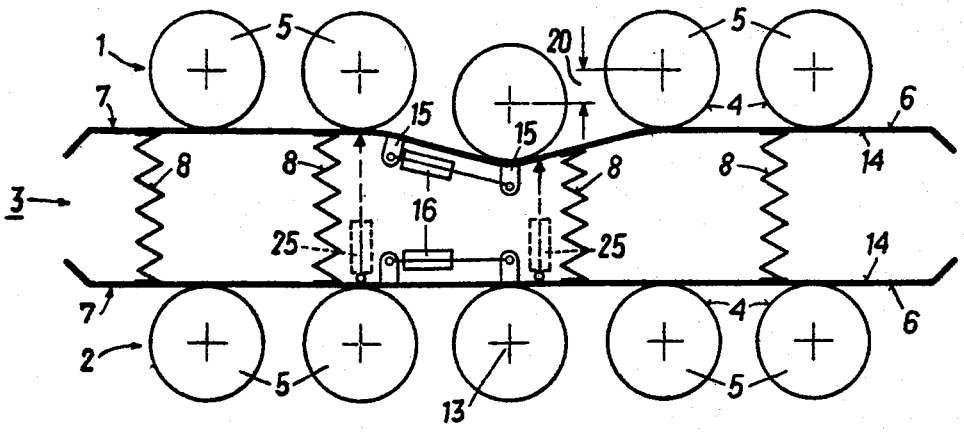
Figure 4:
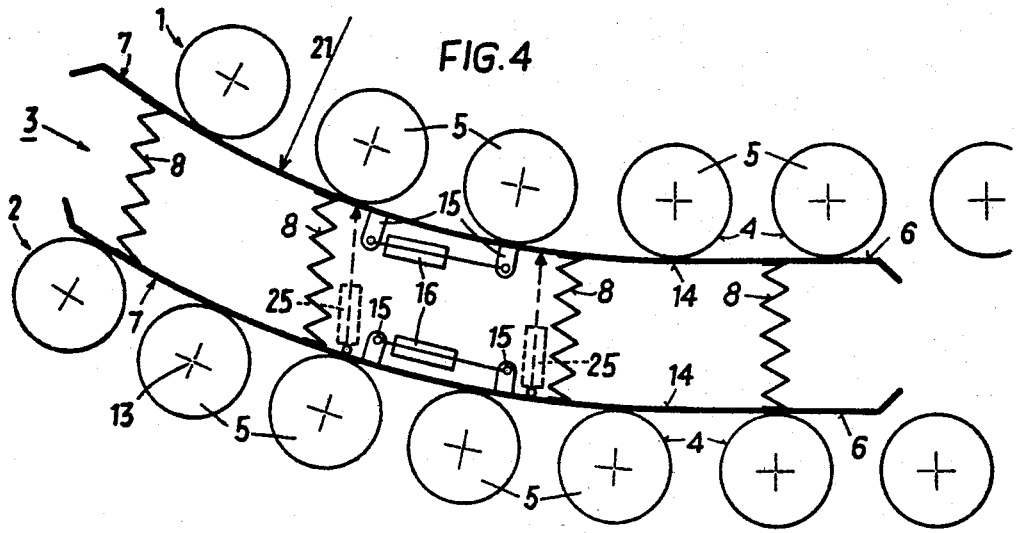

By the arrangement according to the invention, not only a roller offset 18, but, as can be seen from FIGS. 3 and 4, also an offset 20 of a single roller (FIG. 3) as well as the radius of curvature 21 of a rollerway can be ascertained and measured.

Figure 5:
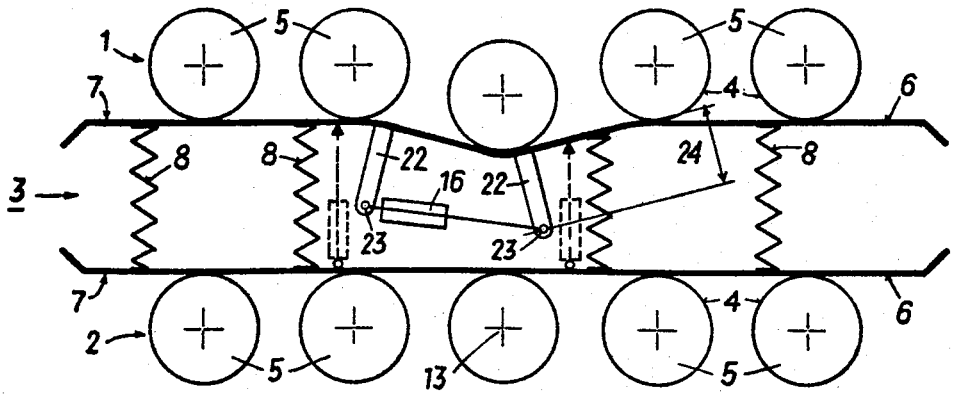
FIG. 5 illustrates a further embodiment of the arrangement according to the invention.
Figure 6:
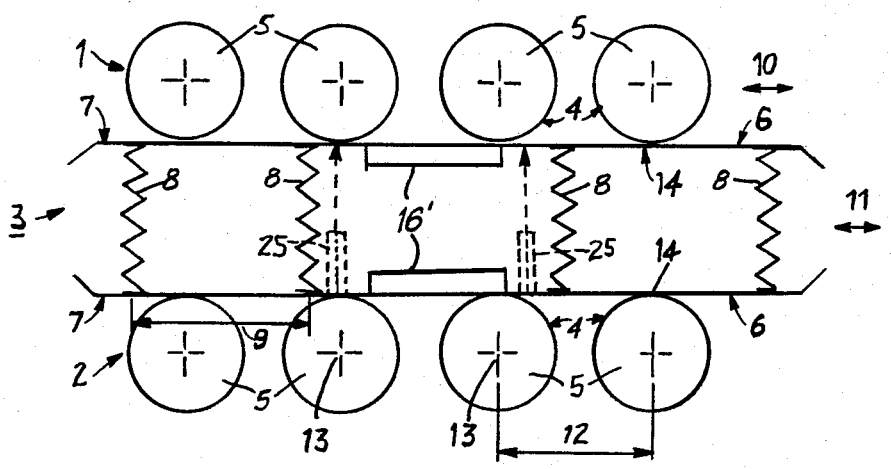
FIG. 6 is an illustration of an alternative embodiment comprising strain gauges analogous to FIG. 1.

According to the embodiment illustrated in FIG. 5, the holding means 22 are designed as consoles directed in the direction perpendicular to the contact surfaces 6 of a spring steel strip 7 and projecting to the vicinity of the opposite spring steel strip 7. The distance-alteration measuring means is inserted between the ends 23 of the consoles 22. Due to the length 24 of the consoles, the distance alteration is indicated by the distance-alteration measuring means 16 to a larger degree so that the arrangement 3 operates with a very high accuracy.

Instead of the inductive distance transducer 16 inserted between the holding means 15 or consoles 22, a strain gauge 16' may be applied directly onto the spring steel strip 7, for instance glued thereto, the longitudinal direction of the strain gauge being directed parallel to the moving direction 11 of the measuring arrangement 3.

In FIGS. 1 to 5 further distance-alteration measuring means 25 are provided parallel to the pressure means 8 pressing the contact surfaces 6 of the spring steel strips 7 to the surface areas 4 of the rollers 5, which further measuring means 25 serve to determine the distance 19 of the rollerways 1, 2 in the manner as described in U.S. Pat. No. 4,361,962. These distance-alteration measuring means are illustrated by broken lines, since they are not necessarily required for the arrangement 3 according to the invention.

The invention is not limited to the embodiment described, but can be modified in various aspects. Thus, it is, for instance, possible to provide the distance-alteration measuring means 16 in an oblique manner, i.e. inclined at an angle to the moving direction, in the arrangement by designing only one of the two consoles 22 (FIG. 5) to be elongated to the vicinity of the opposite spring steel strip 7.

What is essential to the invention is that the distance-alteration measuring means 16 always determines and measures a distance alteration between two points of one of the spring steel strips 7, lying at a distance from each other in the moving direction 11.

In order that the spring steel strips 7 can exactly follow the curvature 21 of the rollerways, the spring steel strips 7 at least have to have a length 26 that corresponds to three times the distance 12 of two neighboring rollers 5, so that each spring steel strip 7 is in contact with at least three rollers 5 of a rollerway 1 or 2. It is advantageous if a recorder recording the measured data of the distance-alteration measuring means 16 is arranged on a box mounted on the coupling piece. It is, however, also possible to transmit the measured values by means of trailing cables or also in a wireless manner by radiotelegraphy.

What I claim is:

1. In an arrangement for measuring two oppositely arranged rollerways of a continuous casting plant equipped with rollers having surface areas, of the type including a measuring body movable through a section formed between said rollerways, said measuring body having contact surfaces formed by a pair of oppositely arranged elastically deformable spring strips contacting said surface areas of said rollers, and pressure means arranged between said contact surfaces for pressing said contact surfaces to said surface areas of said rollers, the improvement comprising a distance alteration measuring means, and mounting means for attaching said distance alteration measuring means in its entirety to an inner side of one of said spring strips, said mounting means comprising holding means mounted on the inner sides of said spring strips, each of said distance-alteration measuring means being inserted between two of said holding means and extending substantially in the moving direction of the arrangement.

2. An arrangement as set forth in claim 1, wherein said spring strips are spring steel strips.

3. An arrangement as set forth in claim 1, wherein a distance-alteration measuring means is arranged on each of said spring strips, said distance-alteration measuring means on one of said spring strips being arranged opposite to the distance-alteration measuring means provided on the other of said spring strips.

4. An arrangement as set forth in claim 1, wherein at least one of said holding means is designed as a console directed approximately perpendicular to said contact surface of its pertaining spring strip and designed to be elongated to the vicinity of the opposite spring strip, said distance-alteration measuring means being inserted between the end of said console and a further one of said holding means.

5. An arrangement as set forth in claim 1, wherein said distance-alteration measuring means is designed as an inductive distance transducer.

* * * * *